US011590510B2

(12) United States Patent
Matsumoto et al.

(10) Patent No.: US 11,590,510 B2
(45) Date of Patent: Feb. 28, 2023

(54) CLASSIFIER, PULVERIZING AND CLASSIFYING DEVICE, AND PULVERIZED COAL BURNING BOILER

(71) Applicant: Mitsubishi Hitachi Power Systems, Ltd., Yokohama (JP)

(72) Inventors: Shinji Matsumoto, Tokyo (JP); Kenichi Arima, Tokyo (JP); Takuichiro Daimaru, Tokyo (JP); Kazushi Fukui, Yokohama (JP); Hidechika Uchida, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 780 days.

(21) Appl. No.: 15/747,610

(22) PCT Filed: Sep. 2, 2016

(86) PCT No.: PCT/JP2016/075745
§ 371 (c)(1),
(2) Date: Jan. 25, 2018

(87) PCT Pub. No.: WO2017/130451
PCT Pub. Date: Aug. 3, 2017

(65) Prior Publication Data

US 2018/0221889 A1 Aug. 9, 2018

(30) Foreign Application Priority Data

Jan. 27, 2016 (JP) ..... JP2016-013143

(51) Int. Cl.
*B02C 23/32* (2006.01)
*B02C 15/04* (2006.01)
(Continued)

(52) U.S. Cl.
CPC ..... *B02C 23/32* (2013.01); *B02C 15/04* (2013.01); *B07B 7/083* (2013.01); *F23K 1/00* (2013.01);
(Continued)

(58) Field of Classification Search
CPC ..... B02C 23/32; B02C 15/04
See application file for complete search history.

(56) References Cited

U.S. PATENT DOCUMENTS 5,622,321 A 4/1997 Brundiek et al.
5,657,877 A 8/1997 Yoshida et al.
(Continued)

FOREIGN PATENT DOCUMENTS

CN 1122263 A 5/1996
CN 1953823 A 4/2007
(Continued)

OTHER PUBLICATIONS

Office Action dated Mar. 18, 2019, issued in counterpart KR application No. 10-2018-7002137, with English translation. (9 pages).
(Continued)

*Primary Examiner* — Nathaniel Herzfeld
(74) *Attorney, Agent, or Firm* — WHDA, LLP

(57) ABSTRACT

A classifier including a housing to take in air flow from below into a radially outer region of an inside space; a flow deflection portion to deflect the air flow toward a center axis of the housing; and an annular rotational portion disposed rotatably in a radially inner region positioned on a radially inner side of the radially outer region, of the inside space of the housing, and configured to classify particles which accompany the air flow. The annular rotational portion includes a plurality of rotational blades arranged at intervals around a rotational axis of the annular rotational portion.
(Continued)

The plurality of rotational blades form an outer shape of the annular rotational portion forms an angle θ of not greater than 75° with a segment extended in a horizontal direction from the annular rotational portion outward in a radial direction, in a side view of the annular rotational portion.

2 Claims, 5 Drawing Sheets

(51) Int. Cl.
*B07B 7/083* (2006.01)
*F23K 1/00* (2006.01)
*B02C 15/00* (2006.01)

(52) U.S. Cl.
CPC .. *B02C 2015/002* (2013.01); *F23K 2201/101* (2013.01); *F23K 2201/1006* (2013.01); *F23K 2201/30* (2013.01)

(56) References Cited

U.S. PATENT DOCUMENTS

| | | | | | |
|---|---|---|---|---|---|
| 5,957,300 | A * | 9/1999 | Nardi | B02C 15/001 209/139.2 |
| 5,976,224 | A * | 11/1999 | Durant | B01D 45/00 110/165 A |
| 2007/0228194 | A1 | 10/2007 | Takeno et al. | |
| 2010/0236458 | A1 | 9/2010 | Otani et al. | |
| 2010/0276525 | A1* | 11/2010 | Matsumoto | B02C 15/04 241/49 |
| 2011/0168819 | A1* | 7/2011 | Wark | B02C 15/001 241/119 |
| 2012/0012687 | A1* | 1/2012 | Vierstra | B02C 23/10 241/79 |

FOREIGN PATENT DOCUMENTS

| | | | | |
|---|---|---|---|---|
| CN | 202010658 | U | 10/2011 | |
| EP | 0 283 682 | A2 | 9/1988 | |
| EP | 0283682 | A2 * | 9/1988 | B02C 23/32 |
| EP | 0 496 124 | A1 | 7/1992 | |
| JP | 60-128786 | U | 8/1985 | |
| JP | 64-22386 | A | 1/1989 | |
| JP | H01-022386 | A | 1/1989 | |
| JP | 4-235755 | A | 8/1992 | |
| JP | H05-68904 | A | 3/1993 | |
| JP | 8-266923 | A | 10/1996 | |
| JP | 2617623 | B2 | 6/1997 | |
| JP | 2004-290726 | A | 10/2004 | |
| JP | 2009-189909 | A | 8/2009 | |
| JP | 2009189909 | A * | 8/2009 | |
| JP | 4340395 | B2 | 10/2009 | |
| JP | 4550486 | B2 | 9/2010 | |
| JP | 2013-178037 | A | 9/2013 | |
| JP | 2013-181680 | A | 9/2013 | |

OTHER PUBLICATIONS

Extended (Supplementary) European Search Report dated May 9, 2018, issued in counterpart application No. 16888037.5. (6 pages).
International Search Report dated Nov. 29, 2016, issued in counterpart Internatinal Application No. PCT/JP2016/075745, with English translation of Written Opinion (13 pages).
Office Action dated Sep. 9, 2019, issued in counterpart KR Application No. 10-2018-7002137, with English translation. (7 pages).
Office Action dated Sep. 17, 2019, issued in counterpart JP Application No. 2016-013143, with English translation. (9 pages).
Office Action dated Jan. 6, 2020, issued in counterpart CN Application No. 201680043547.7. (8 pages).
Office Action dated Dec. 11, 2020, issued in counterpart EP application No. 16888037.5. (5 pages).

* cited by examiner

CLASSIFIER, PULVERIZING AND CLASSIFYING DEVICE, AND PULVERIZED COAL BURNING BOILER

TECHNICAL FIELD

The present disclosure relates to a classifier, a pulverizing and classifying device including the classifier, and a pulverized coal burning boiler including the pulverizing and classifying device.

BACKGROUND ART

A known classifier classifies particles having different particle sizes by utilizing a centrifugal force generated by rotation of a rotor.

For instance, Patent Document 1 discloses a rotor classifier having a plurality of rotational blades around a rotational axis. In the classifier, swirl is imparted by rotation of the rotational blades, to an air flow that flows accompanied by particles from the radially outer side of the classifier. As a result, a centrifugal force directed outward in the radial direction due to the centrifugal field formed by the rotational blades is applied to particles accompanying the air flow. Thus, coarse particles having a relatively greater particle size receive a stronger centrifugal force than drag caused by the velocity component of the air flow directed inward in the radial direction, and are thrown outside the rotational blades. On the other hand, micro particles having a relatively smaller particle size receive drag directed inward in the radial direction applied by the air flow, which is stronger than the centrifugal force, and pass through the rotational blades. As described above, in the classifier according to Patent Document 1, coarse particles included in an air flow are thrown out of the rotational blades, while micro particles pass through the radially inner side of the rotational blades. In this way, particles carried by the air flow are classified.

Patent Documents 2 and 3 disclose a classifier including both of a fixed classifier having fixed blades and a rotational classifier.

CITATION LIST

Patent Literature

Patent Document 1: JP5716272B
Patent Document 2: JP2617623B
Patent Document 3: JP4340395B

SUMMARY

Problems to be Solved

It is required to let a minimum possible ratio of coarse particles pass through the classifier.

However, primary air that is supplied from an air inlet vane and moves upward to the inlet of the classifying part may interfere with a flow of coarse particles that return to a pulverizing table without passing through the classifier. Accordingly, the coarse particles accumulate near the inlet of the classifier, and the ratio of coarse particles that pass through the classifier increases, which may reduce the fineness of the particles on the side of the outlet of the classifier. Furthermore, the amount of coarse particles that circulate unpulverized inside the housing increases, and thus pressure loss inside the housing increases, which may increase kinetic energy required to operate the pulverizing device.

Neither of Patent Documents 1 and 3 discloses a solution to the above problem. Patent Document 2 discloses a configuration for avoiding interference between coarse particles and primary air, by sending the coarse particles into a space near the housing center axis with the rotational blades, and providing a funnel between the coarse particles and the primary air moving upward in the radially outer region.

In view of the above, an object of at least one embodiment of the present invention is to provide a classifier capable of suppressing a decrease in the fineness on the outlet side of the classifier and suppress pressure loss inside the housing, so as to suppress an increase in energy consumption, without a funnel, a pulverizing and classifying device having the same, and a pulverized coal burning boiler having the same.

Solution to the Problems (1) A classifier according to at least one embodiment of the present invention comprises: a housing configured to take in an air flow from below into a radially outer region of an inside space; a flow deflection portion disposed on an inner wall surface of the housing and configured to deflect the air flow toward a center axis of the housing; and an annular rotational portion disposed rotatably in a radially inner region positioned on a radially inner side of the radially outer region, of the inside space of the housing, and configured to classify particles which accompany the air flow. The annular rotational portion includes a plurality of rotational blades arranged at intervals around a rotational axis of the annular rotational portion. The plurality of rotational blades form an outer shape of the annular rotational portion which forms an angle θ of not greater than 75° with a segment extended in a horizontal direction from the annular rotational portion outward in a radial direction, in a side view of the annular rotational portion.

With the above configuration (1), the air flow being accompanied by pulverized particles and flowing upward in the radially outer region is deflected toward the center axis of the housing by the flow deflection portion. The coarse particles that accompany an upward air flow have an upward inertia. The coarse particles hit the annular rotational portion and bounce off toward a region where the flow velocity of the upward air flow is low (radially outer region of the housing), and returns to the pulverizing part from the radially outer region. At this time, with the angle θ being not greater than 75° as in the above configuration (1), it is possible to ensure a flow-path cross-sectional area of the radially outer region of the housing, and it is possible to prevent interference between the upward air flow and coarse particles moving toward the pulverizing part (return of coarse particles), even in a case where a funnel is not provided.

By preventing interference between the upward air flow and the returning coarse particles, it is possible to suppress accumulation of the coarse particles in the vicinity of the classifier. Thus, it is possible to suppress a decrease in the fineness of the micro particles at the outlet side of the classifier. Furthermore, it is possible to return the coarse particles smoothly to the pulverizing part, and thus it is possible to reduce the amount of coarse particles that circulate inside the housing, thereby reducing pressure loss inside the housing and suppressing an increase in energy consumption of the pulverizing device.

(2) In some embodiments, in the above configuration (1), the angle θ satisfies $50° \leq \theta \leq 70°$.

With the above configuration (2), if $\theta \leq 70°$, it is possible to ensure the radially outer space of the annular rotational portion, and thus it is possible to avoid interference between the coarse particles and the upward air flow. Furthermore, if $50° \leq \theta$, it is possible to suppress a decrease in the flow-path cross-sectional area of the radially outer region of the annular rotational portion, and thus it is possible to suppress a decrease in the classifying accuracy due to a flow velocity increase of the air flow passing through the annular rotational portion.

(3) In some embodiments, in the above configuration (1) or (2), each of the rotational blades is arranged obliquely with respect to a vertical direction such that an upper end of the rotational blade is positioned on an upstream side of a lower end of the rotational blade, with respect to a rotational direction of the annular rotational portion.

With the above configuration (3), it is possible to orient upward a surface of the rotational blade which is to hit particles accompanying the air flow, and thus it is possible to cause the coarse particles, which hit the rotational blades, to bounce off upward to the radially outer side of the housing. Accordingly, thanks to the synergy with the above configuration (1), it is possible to suppress interference between the bounced-off coarse particles and the upward air flow.

(4) In some embodiments, in any one of the above configurations (1) to (3), the classifier further comprises a material feed pipe extending downward into the housing of the classifier from an upper part of the housing of the classifier. The plurality of rotational blades of the annular rotational portion are disposed around the material feed pipe. Further, provided that H is a total height of the annular rotational portion and $h_0$ is a height position of a lower end of the material feed pipe, a height position h of a lower end of the plurality of rotational blades satisfies a relationship $h_0-0.1H \leq h \leq h_0+0.1H$.

With the above configuration (4), it is possible to extend the height position of the lower end of the rotational blades substantially to the lower end of the material feed pipe, and θ is not greater than 75°. Thus, it is possible to reduce the radially outward protrusion of the annular rotational portion from the lower end surface of the material feed pipe. Thus, even in a case where the rectifying cone is not provided, it is possible to prevent the lower end surface of the annular rotational portion (protrusion of the annular rotational portion from the lower end surface of the material feed pipe) from blocking the air flow flowing toward the annular rotational portion.

(5) A pulverizing and classifying device according to at least one embodiment of the present invention comprises: a pulverizing part including a pulverizing table disposed rotatably below the annular rotational portion inside the housing, and a pulverizing roller for pulverizing a material fed onto the pulverizing table; and the classifier according to any one of the above (1) to (4) for classifying particles produced by pulverization of the material at the pulverizing part.

With the above configuration (5), the pulverizing and classifying device includes the classifier according to any one of the above (1) to (4), and thereby it is possible to suppress interference between the upward air flow and the coarse particles bounced off at the annular rotational portion, even in a case where a funnel is not provided.

Thus, it is possible to suppress accumulation of the coarse particles in the vicinity of the inlet of the classifier. Thus, it is possible to suppress a decrease in the fineness of the micro particles at the outlet side of the classifier. Furthermore, it is possible to return the coarse particles smoothly to the pulverizing part, and thus it is possible to reduce the amount of coarse particles that circulate inside the housing, thereby reducing pressure loss inside the housing and suppressing an increase in energy consumption of the pulverizing device.

(6) In some embodiments, in the above configuration (5), the pulverizing part is configured to pulverize coal being the material, and the classifier is configured to classify pulverized coal from coal particles obtained by pulverizing the coal at the pulverizing part and take the pulverized coal outside.

With the above configuration (6), in a case where coal is the material, it is possible to suppress interference between the upward air flow 'f' and coarse particles of coal bounced off at the annular rotational portion. Thus, it is possible to suppress accumulation of the coarse particles of coal in the vicinity of the classifier. Thus, it is possible to suppress a decrease in the fineness of the micro particles of coal at the outlet side of the classifier. Furthermore, it is possible to return the coarse particles of coal smoothly to the pulverizing part, and thus it is possible to reduce the amount of coarse particles of coal that circulate inside the housing, thereby reducing pressure loss inside the housing and suppressing an increase in energy consumption of the pulverizing and classifying device.

(7) A pulverized coal burning boiler according to at least one embodiment of the present invention comprises: the pulverizing and classifying device according to the above configuration (6); and a furnace for combusting the pulverized coal obtained by the pulverizing and classifying device.

With the above configuration (7), the pulverizing and classifying device includes the classifier having the above configuration, and thereby it is possible to suppress interference between the upward air flow and the coarse particles of coal separated from the pulverized coal by the classifier, even in a case where a funnel is not provided. Thus, it is possible to suppress accumulation of the coarse particles of coal in the vicinity of the classifier. Thus, it is possible to improve the fineness of the micro particles of coal at the outlet side of the classifier. Accordingly, in the pulverized coal burning boiler, it is possible to suppress production of unburnt combustible content and improve the combustion efficiency.

Furthermore, it is possible to reduce the amount of coarse particles of coal that circulate inside the housing, thereby reducing pressure loss inside the housing and suppressing an increase in energy consumption of the pulverizing and classifying device.

Advantageous Effects

According to at least one embodiment of the present invention, it is possible to suppress interference between the upward air flow and the coarse particles separated from the micro particles at the annular rotational portion, even in a case where a funnel is not provided. Thus, it is possible to suppress accumulation of the coarse particles in the vicinity of the classifier, thereby suppressing a decrease in the fineness of the micro particles at the outlet side of the coarse particle. Also, it is possible to suppress an increase in pressure loss inside the housing in the pulverizing and classifying device and suppress an increase in energy consumption.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

First, with reference to FIGS. 1 and 6, the configuration of the classifier 10 (10A, 10B) according to some embodiments will be described.

The classifier 10 includes a housing 12 which is configured to introduce an air flow 'f' from below into a radially outer region So of the inside space of the housing 12. A flow deflection portion 14 is disposed on the inner wall surface of the housing 12, and is configured to deflect the air flow 'f' moving upward through the radially outer region So toward the center axis O of the housing 12. In an embodiment, the flow deflection portion 14 is disposed on the inner wall surface of the housing 12, along the circumferential direction of the housing 12. In this case, the flow deflection portion 14 may be disposed on the inner wall surface of the housing 12 over the entire circumference of the housing 12.

Of the inside space of the housing 12, an annular rotational portion 16 is disposed in the radially inner region Si positioned inside the radially outer region So in the radial direction. The annular rotational portion 16 is provided rotatably, and is configured to classify particles that accompany the air flow 'f'.

Figure 2:
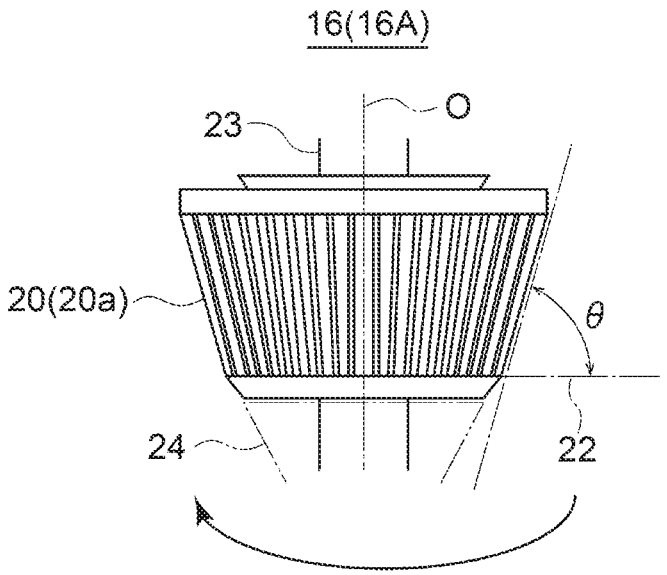
FIG. 2 is a front view of an annular rotational portion according to an embodiment.
Figure 3:
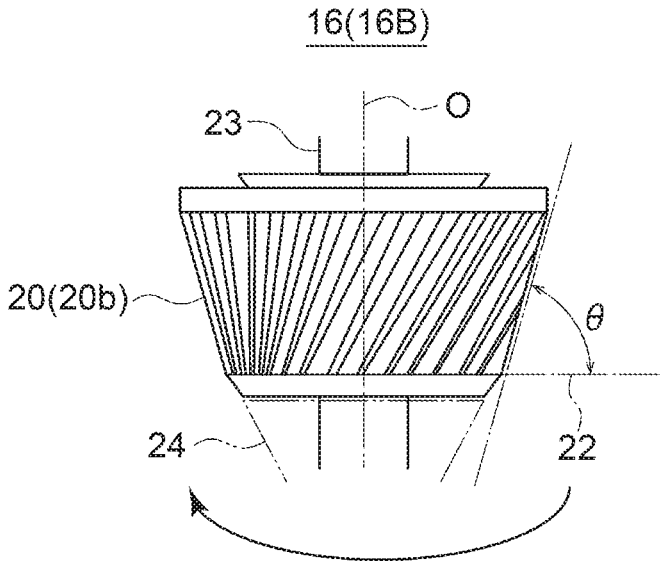
FIG. 3 is a front view of an annular rotational portion according to an embodiment.
Figure 6:
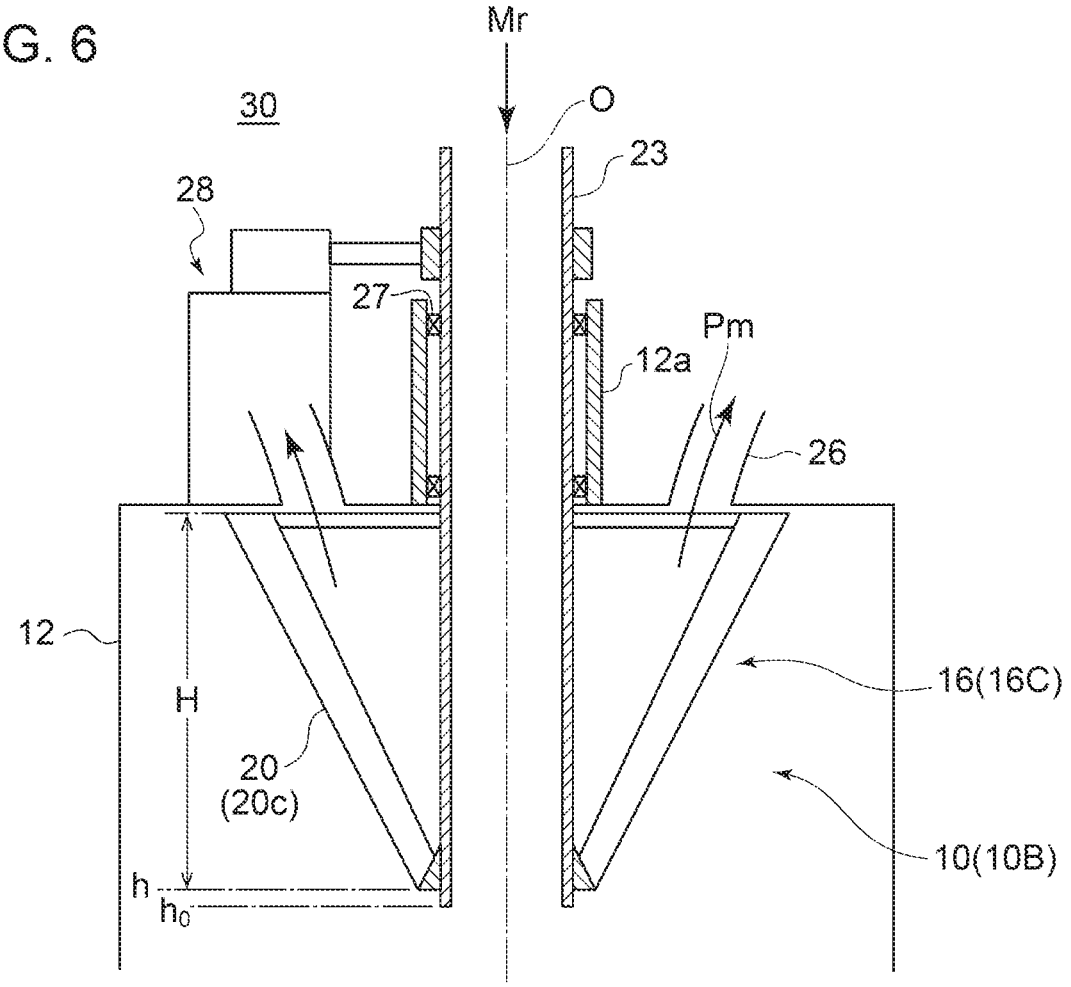
FIG. 6 is a front cross-sectional view of a classifier according to an embodiment.

As shown in FIGS. 2, 3, and 6, the annular rotational portion 16 (16A, 16B, 16C) according to some embodiments has a plurality of rotational blades 20 (20*a*, 20*b*, 20*c*) arranged with intervals between one another, around the rotational axis (center axis O of the housing 12). The outer shape of the annular rotational portion 16 formed by the plurality of rotational blades 20 is configured such that the angle θ formed with respect to a segment 22 extended in the horizontal direction is not greater than 75°, in a side view of the annular rotational portion 16.

Figure 1:
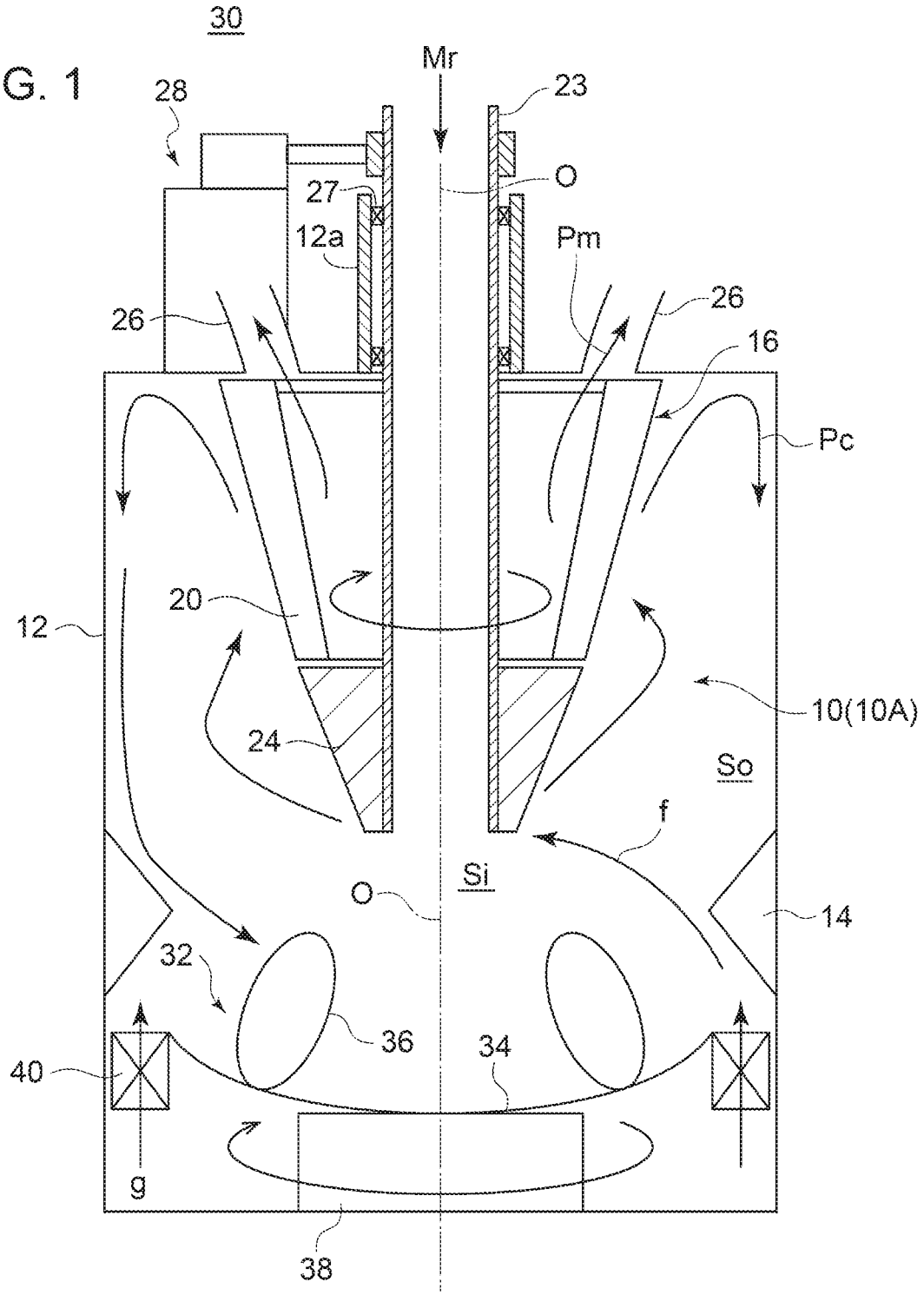
FIG. 1 is a front cross-sectional view of a pulverizing and classifying device according to an embodiment.

In the depicted embodiment, as shown in FIGS. 1 and 6, a feed pipe 23 for a pulverization material Mr is disposed in the vertical direction, along the center axis O of the housing 12. A ring portion 12*a* is formed integrally with the housing 12 so as to surround the feed pipe 23, and the feed pipe 23 is supported on the ring portion 12*a* rotatably via a bearing 27 so as to be rotatable about the center axis O. The annular rotational portion 16 is disposed in the middle of the upper region inside the housing 12 and mounted to the feed pipe 23, so as to be rotatable with the feed pipe 23.

In the classifier 10 (10A) shown in FIG. 1, a rectifying cone 24 is disposed on the feed pipe 23, at a position below the annular rotational portion 16.

After passing through the annular rotational portion 16, micro particles Pm are sent to a consumer from a discharge pipe 26. A driving part 28 for rotating the feed pipe 23 is disposed on the upper surface of the housing 12.

As shown in FIG. 1, a pulverizing part 32 for pulverizing a pulverization material Mr fed from the feed pipe 23 into the housing 12 is disposed below the classifier 10. The classifier 10 and the pulverizing part 32 constitute a pulverizing and classifying device 30.

In such a configuration, an upward air flow 'f' accompanied by pulverized particles pulverized by the pulverizing part 32 is deflected toward the center axis O by the flow deflection portion 14. Accordingly, a region where the air flow has a low flow velocity is formed in the radially outer region So above the flow deflection portion 14 (downstream side of the flow deflection portion 14 as seen from the upward air flow 'f').

The pulverization particles accompanying the air flow 'f' is classified into micro particles Pm and coarse particles Pc by centrifugal classification and collision classification by rotation of the rotational blades 20, and the micro particles Pm pass through the gap formed between the rotational blades 20.

The coarse particles Pc hit the rotational blades 20 and bounce off. The coarse particles Pc have an upward inertia. The coarse particles Pc hit the rotational blades 20 and bounce off toward the radially outer region So where the flow velocity of the air flow is low, and returns to the pulverizing part 32 from the radially outer region So. At this time, θ is not greater than 75°, and thus it is possible to ensure the flow-path cross-sectional area of the radially outer region So, and thereby to suppress interference between the upward air flow 'f' and the coarse particles Pc moving toward the pulverizing part 32.

By preventing interference between the upward air flow 'f' and the coarse particles Pc, it is possible to suppress accumulation of the coarse particles Pc in the vicinity of the classifier. Thus, it is possible to suppress a decrease in the fineness of the micro particles Pm at the outlet side of the classifier. Furthermore, the coarse particles Pc having bounced off toward the radially outer region So can return smoothly to the pulverizing part 32 from the radially outer region So where the flow velocity of the upward air flow 'f' is low, and thus it is possible to reduce the amount of coarse particles Pc that circulate inside the housing, thereby reducing pressure loss inside the housing and suppressing an increase in energy consumption of the pulverizing and classifying device 30.

In the embodiment shown in FIG. 2, each rotational blade 20 (20*a*) of the annular rotational portion 16 (16A) has an upper end and a lower end disposed at the same position with respect to the rotational direction (arrow direction) of the annular rotational portion.

In another embodiment, as shown in FIG. 3, each rotational blade 20 (20*a*) of the annular rotational portion 16 (16B) is disposed obliquely with respect to the vertical direction, such that the upper end of the rotational blade is disposed on the upstream side of the lower end of the rotational blade with respect to the rotational direction (arrow direction) of the annular rotational portion.

In this case, it is possible to orient upward a surface of the rotational blade 20*b* which is to hit particles accompanying the air flow 'f', and thus it is possible to cause the coarse particles, which hit the rotational blades 20*b*, to bounce off upward to the radially outer side of the housing 12. Accordingly, thanks to the synergy with the above configuration of the annular rotational portion 16 where the angle θ formed with the segment 22 is not greater than 75°, it is possible to suppress interference between the bounced-off coarse particles Pc and the upward air flow 'f'.

In an illustrative embodiment, the angle θ formed between the segment 22 and the outer shape of the annular rotational portion 16 formed by the plurality of rotational blades 20 satisfies $50° \leq \theta \leq 70°$.

If $\theta \leq 70°$, it is possible to ensure the radially outer region So of the annular rotational portion 16, and thus it is possible to suppress interference between the coarse particles Pc and the air flow 'f' more effectively. If $50° \leq \theta$, it is possible to suppress a decrease in the flow-path cross-sectional area of the radially outer region So of the annular rotational portion 16, and thus it is possible to suppress a decrease in the classifying accuracy due to a flow velocity increase of the air flow passing through the annular rotational portion 16.

Figure 4:
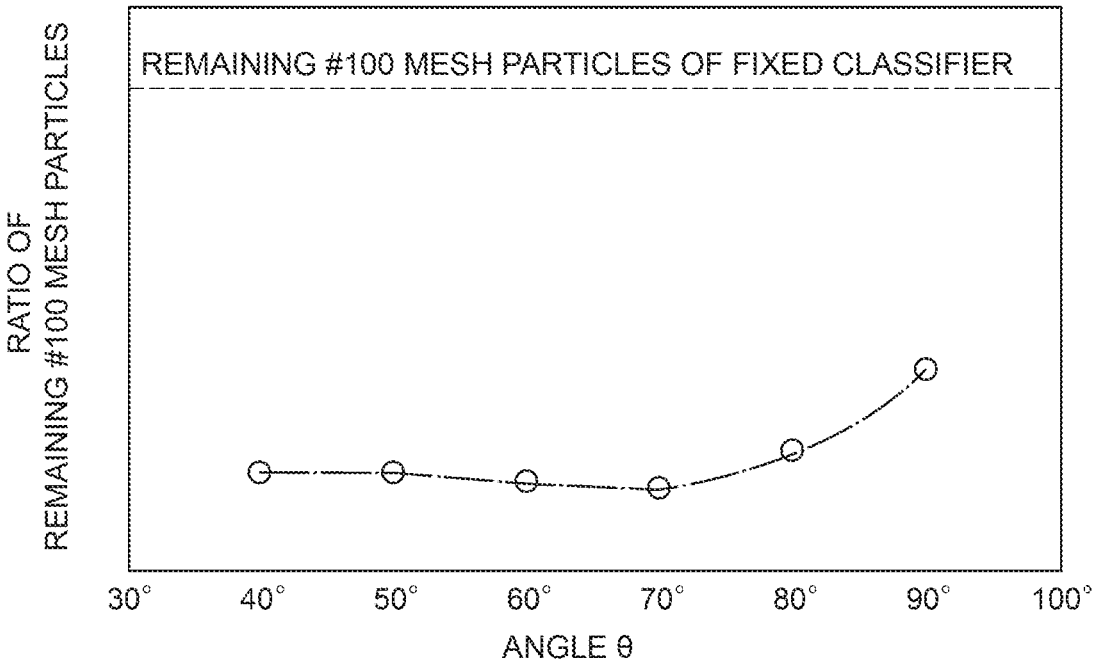
FIG. 4 is a graph showing a classifying accuracy of a classifier according to an embodiment.
Figure 5:
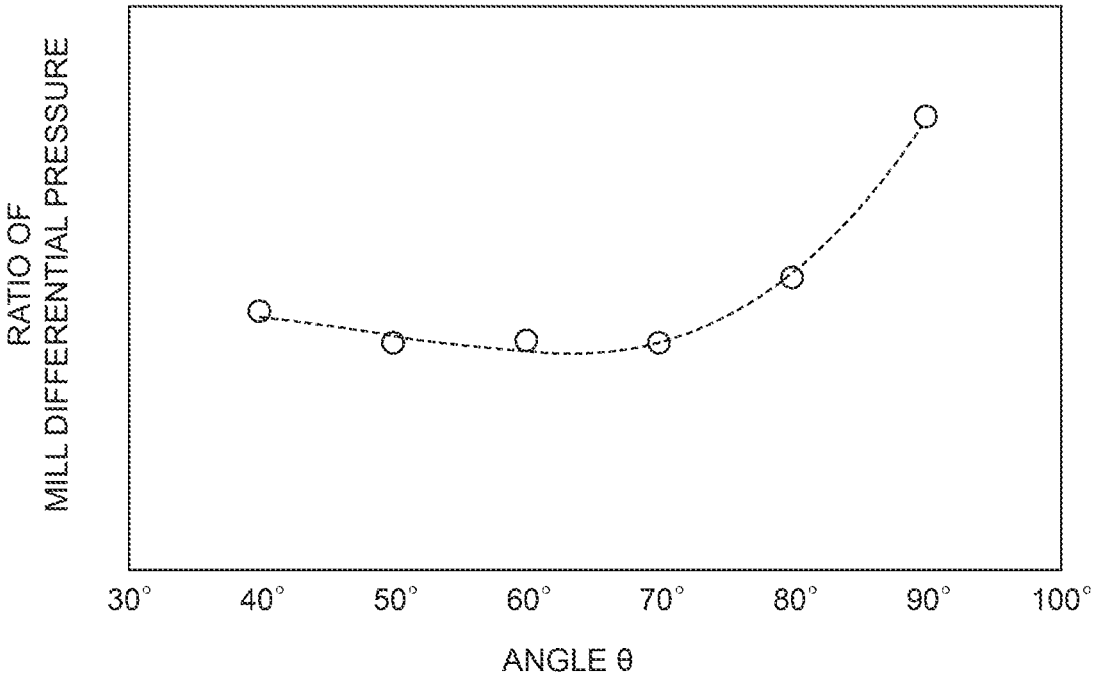
FIG. 5 is a graph showing pressure loss of a classifier according to an embodiment.

FIGS. 4 and 5 are charts showing a relationship between the angle θ and the classifying accuracy or the like of the classifier 10, obtained by the present inventors. The y-axis in FIG. 4 represents the amount of coarse particles Pc of 100 mesh (particle size=150 μm) contained in the micro particles Pm having passed through the annular rotational portion 16. The y-axis in FIG. 5 represents a differential pressure ratio of the inlet and the outlet of the housing 12.

From FIG. 4, it is clear that it is possible to reduce the amount of coarse particles Pc that pass through the classifier considerably compared to a fixed classifier with fixed blades, and that the amount of coarse particles Pc having the above particle size that pass through the annular rotational portion 16 increases considerably when θ exceeds 75°. That is, by setting $\theta \leq 75°$, it is possible to reduce the passage amount of coarse particles Pc as compared to a case of $\theta > 75°$.

Furthermore, FIG. 4 shows that the amount of coarse particles Pc increases slightly when θ is less than 50°. Furthermore, also in the range of $70° \leq \theta \leq 75°$, the amount of coarse particles Pc increases slightly compared to a case of $50° \leq \theta \leq 70°$. Thus, by setting $50° \leq \theta \leq 70°$, it is possible to improve the classifying accuracy of the annular rotational portion 16.

On the other hand, from FIG. 5, if θ exceeds 75°, the housing internal pressure increases. Thus, by setting $\theta \leq 75°$, it is possible to suppress pressure loss inside the housing, and to suppress an increase in energy consumption of the pulverizing and classifying device 30.

Furthermore, from FIG. 5, by setting $50° \leq \theta \leq 70°$, it is possible to suppress pressure loss inside the housing 12 more effectively.

Thus, by setting $50° \leq \theta \leq 70°$, it is possible to improve the classifying accuracy of the classifier 10 even further. Furthermore, it is possible to suppress an increase in the housing internal pressure, and to reduce the energy consumption of the pulverizing and classifying device 30 even further.

In an illustrative embodiment, in the classifier 10 (10B) shown in FIG. 6, the plurality of rotational blades 20 (20*c*) of the annular rotational portion 16 (16C) are disposed around the material feed pipe 23. Furthermore, provided that H is the total height of the annular rotational portion 16 (16C) and $h_0$ is the height position of the lower end of the material feed pipe 23, the height position h of the lower end of the plurality of rotational blades 20 (20*c*) satisfies a relationship $h_0 - 0.1H \leq h \leq h_0 + 0.1H$.

Accordingly, it is possible to extend the height position h of the lower end of the rotational blades 20 (20*c*) substantially to the lower end of the material feed pipe 23, and θ is not greater than 75°. Thus, it is possible to reduce the radially outward protrusion of the rotational blade 20 (20*c*) from the lower end surface of the material feed pipe 23. Thus, as shown in FIG. 6, even in a case where the rectifying cone 24 is not disposed below the annular rotational portion 16 (16C), it is possible to prevent the lower end surface of the annular rotational portion 16 (16C) (radially outward protrusion of the annular rotational portion 16 (16C) from the lower end surface of the material feed pipe 23) from blocking the air flow 'f' flowing toward the annular rotational portion 16 (16C).

In some embodiments, as shown in FIG. 1, the pulverizing and classifying device 30 includes the classifier 10 and the pulverizing part 32 disposed below the annular rotational portion 16, inside the housing 12.

In an embodiment, the pulverizing part 32 includes a pulverizing table 34 provided rotatably, and a pulverizing roller 36 for pulverizing a material (object to be pulverized) fed to the pulverizing table 34.

In the depicted embodiment, the pulverizing table 34 is rotated by a driving part 38 in the direction of the arrow. An air inlet vane 40 is disposed on the outer periphery of the pulverizing table 34, and carrier gas 'g' jets up into the housing 12 from the air inlet vane 40 to form the upward air flow 'f'.

The air inlet vane 40 includes, for instance, a plurality of vanes (not shown) arranged at intervals between one another, and swirl is applied to the carrier gas 'g' as the carrier gas 'g' passes through the vanes. The air flow 'f' with swirl imparted thereto moves upward while swirling in the radially outer region So.

With the above configuration, the pulverizing and classifying device 30 includes the classifier 10, and thereby it is possible to suppress interference between the upward air flow 'f' and the coarse particles Pc bounced off at the annular rotational portion 16, even in a case where a funnel is not provided at a height position between the annular rotational portion 16 and the pulverizing part 32.

Thus, it is possible to suppress accumulation of the coarse particles Pc in the vicinity of the inlet of the annular rotational portion. Thus, it is possible to suppress a decrease in the fineness of the micro particles Pm at the outlet side of the classifier. Furthermore, it is possible to return the coarse particles Pc smoothly to the pulverizing part 32, and thus it is possible to reduce the amount of coarse particles Pc that circulate inside the housing, thereby reducing pressure loss inside the housing and suppressing an increase in energy consumption of the pulverizing and classifying device 30.

In an embodiment, the material fed to the pulverizing and classifying device 30 (object to be pulverized) is coal. The classifier 10 classifies coal particles pulverized by the pulverizing part 32 into micro particles and coarse particles, and takes the micro particles outside.

Accordingly, in a case where coal is the material, it is possible to suppress accumulation of coarse particles of coal in the vicinity of the inlet of the classifier. Thus, it is possible to suppress a decrease in the fineness of micro particles of coal at the outlet side of the classifier. Furthermore, the coarse particles of coal return smoothly to the pulverizing part 32, which promotes re-pulverization of the coarse particles of coal, and thus it is possible to reduce the amount of coarse particles of coal that circulate inside the housing, thereby reducing pressure loss inside the housing and suppressing an increase in energy consumption of the pulverizing and classifying device.

Figure 7:
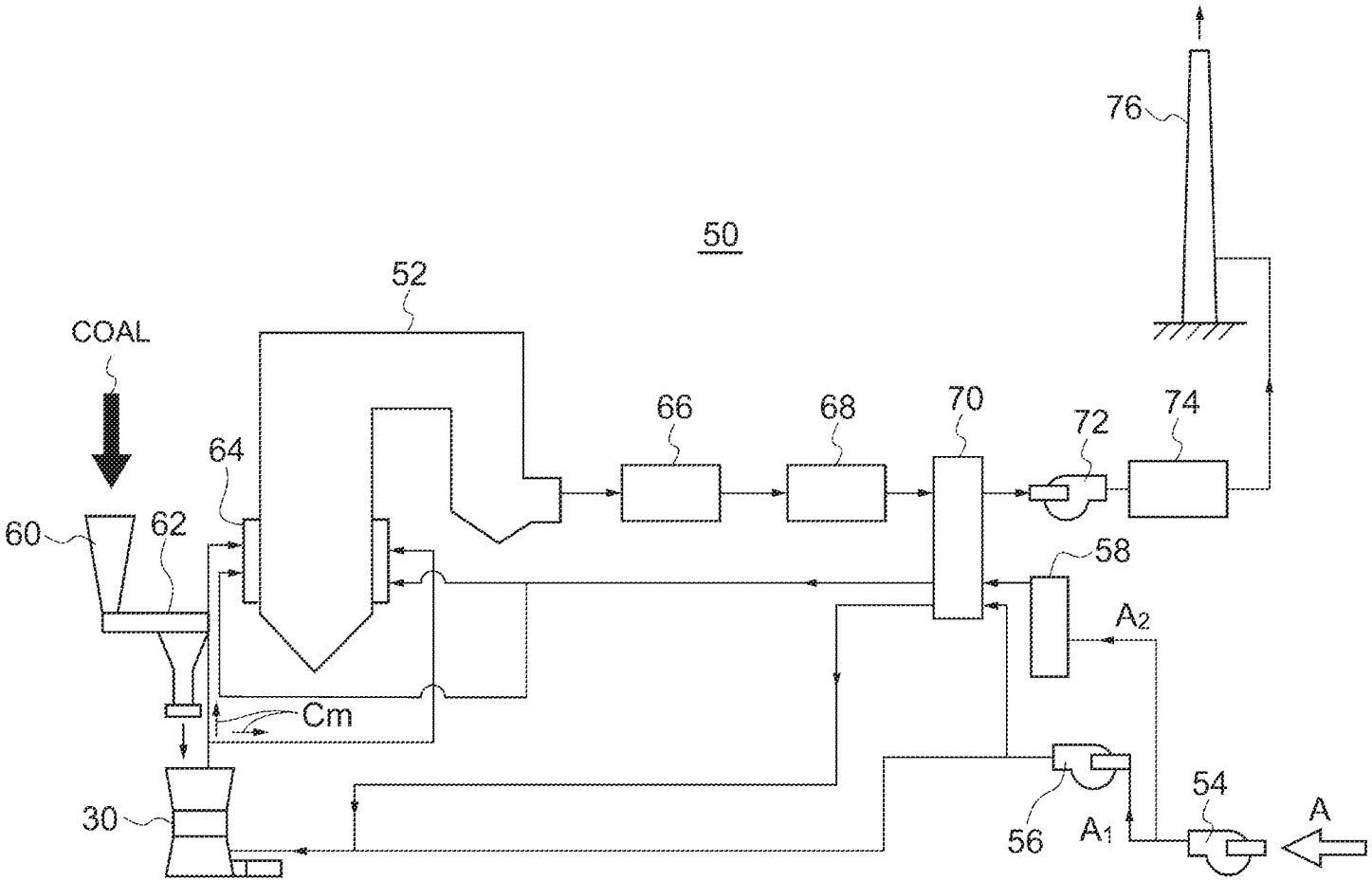
FIG. 7 is a system diagram of a pulverized coal burning boiler according to an embodiment.

As shown in FIG. 7, a pulverized coal burning boiler 50 according to an embodiment includes a pulverizing and classifying device 30, and a furnace 52 for combusting pulverized coal Cm obtained by the pulverizing and classifying device 30.

In the depicted embodiment, air A is sent into the pulverizing and classifying device 30 from a blower 54, and coal is fed to the pulverizing and classifying device 30 as a material (object to be pulverized) from a coal bunker 30 and a coal feeder 62.

The combustion air A sent into the blower 54 is branched into air $A_1$ and air $A_2$. The air $A_1$ is sent to the pulverizing and classifying device 30 by a blower 56. A part of the air $A_1$ is heated by a pre-heater 70 and sent to the pulverizing and classifying device 30 by a blower 70 as warm air. Herein, the warm air heated by the pre-heater 70 and cool air directly sent from the blower 56 without passing through the pre-heater 70 may be mixed to obtain adjusted air mixture having an appropriate temperature, which is to be fed to the pulverizing and classifying device 30. As described above, the air $A_1$ supplied to the pulverizing and classifying device 30 is injected into the housing 12 from the air inlet vane 40 (see FIG. 1), inside the pulverizing and classifying device 30.

Coal being the pulverization material Mr is input into the coal bunker 60, and then a regular amount of the coal is fed to the pulverizing and classifying device 30 via the feed pipe 23 (see FIG. 1) by the coal feeder 62. The pulverized coal Cm is produced by being pulverized by the pulverizing and classifying device 30 while being dried by the air flow 'f' of the air $A_1$ from the air inlet vane 40. Then, the pulverized coal Cm is carried out by the air $A_1$ from the discharge pipe 26 (see FIG. 1) and sent to the furnace (boiler body) 52 via a pulverized coal burner (not shown) inside a wind box 64 of the furnace 52, to be ignited and combusted by a burner.

The air $A_2$ of the combustion air A sent into the blower 54 is heated by the pre-heater 58 and the pre-heater 70, and sent to the furnace 52 via the wind box 64, to serve in combustion of pulverized coal Cm inside the furnace 52.

Exhaust gas produced through combustion of pulverized coal Cm in the furnace 52 is deprived of dust by a dust collector 66, and is sent to a denitration device 68, where nitrogen oxide (NOx) contained in the exhaust gas is reduced. Further, the exhaust gas is sucked in by the blower 72 via the pre-heater 70, deprived of surfer by a desulfuration device 74, and released to the atmosphere from a chimney 76.

The above described pulverized coal burning boiler 50 is capable of returning coarse particles Pc separated from pulverized coal Cm by the classifier 10 smoothly to the pulverizing table 34. In this way, it is possible to improve the fineness of pulverized coal Cm having passed through the classifier 10, and to reduce pressure loss inside the housing 12, thereby suppressing an increase in energy consumption of the pulverizing and classifying device 30.

Furthermore, pulverized coal Cm containing a reduced amount of coarse particles Pc is combusted, and thus it is possible to reduce air pollutant such as NOx in combustion gas and reduce unburnt combustible content in ash, thereby improving the boiler efficiency.

INDUSTRIAL APPLICABILITY

According to at least one embodiment of the present invention, it is possible to provide a rotary classifier capable of suppressing a decrease in the fineness on the outlet side of the classifier and suppress pressure loss inside the housing, to suppress an increase in energy consumption, without a funnel.

DESCRIPTION OF REFERENCE NUMERALS

10 (10A, 10B) Classifier
12 Housing
12*a* Ring portion
14 Flow deflection portion
16 (16A, 16B, 16C) Annular rotational portion
20 (20*a*, 20*b*, 20*c*) Rotational blade
22 Segment
23 Feed pipe
24 Rectifying cone
26 Discharge pipe
27 Bearing
28, 38 Driving part
30 Pulverizing and classifying device
32 Pulverizing part
34 Pulverizing table
36 Pulverizing roller
40 Air inlet vane
50 Pulverized coal burning boiler
52 Furnace
A, $A_1$, $A_2$ Combustion air
Cm Pulverized coal
Mr Pulverization material
O Center axis
Pc Coarse particle
Pm Micro particle
Si Radially inner region
So Radially outer region
f Air flow

The invention claimed is:

1. A classifier, comprising:

a housing configured to take in an air flow from below into a radially outer region of an inside space;

a flow deflection portion disposed on an inner wall surface of the housing and configured to deflect the air flow toward a center axis of the housing; and an annular rotational portion disposed rotatably in a radially inner region positioned on a radially inner side of the radially outer region, of the inside space of the housing, and configured to classify particles which accompany the air flow, wherein the annular rotational portion includes a plurality of rotational blades arranged at intervals around a rotational axis of the annular rotational portion, and wherein the plurality of rotational blades form an outer shape of the annular rotational portion which forms an angle θ of not greater than 75° with a segment extended in a horizontal direction from the annular rotational portion outward in a radial direction, in a side view of the annular rotational portion, and wherein the classifier further comprises a material feed pipe extending downward into the housing of the classifier from an upper part of the housing of the classifier, wherein the plurality of rotational blades of the annular rotational portion are disposed around the material feed pipe, and wherein, provided that H is a total height of the annular rotational portion, a vertical distance between a lower end of the material feed pipe and a lower end of the plurality of rotational blades is not greater than 0.1H.

2. The classifier according to claim 1, wherein each of the rotational blades is arranged obliquely with respect to a vertical direction such that an upper end of the rotational blade is positioned on an upstream side of a lower end of the rotational blade, with respect to a rotational direction of the annular rotational portion.

* * * * *